United States Patent [19]

Krusche

[11] Patent Number: 4,494,661

[45] Date of Patent: Jan. 22, 1985

[54] STORAGE DEVICE

[75] Inventor: Kurt Krusche, Frankfurt am Main, Fed. Rep. of Germany

[73] Assignee: Allstar Verbrauchsguter GmbH & Co., KG, Frankfurt am Main, Fed. Rep. of Germany

[21] Appl. No.: 351,259

[22] Filed: Feb. 22, 1982

[30] Foreign Application Priority Data

Mar. 6, 1981 [DE] Fed. Rep. of Germany ... 8106304[U]

[51] Int. Cl.[3] ..... A47F 5/08

[52] U.S. Cl. ..... 211/87; 211/88; 248/220.3; 248/221.4; D6/570

[58] Field of Search ..... 211/87, 90, 126, 88, 211/194, 188; D6/136, 192; 248/220.2, 220.3, 221.3, 221.4; 403/247, 252, 254

[56] References Cited

U.S. PATENT DOCUMENTS

| | | | |
|---|---|---|---|
| D. 207,041 | 2/1967 | Goldstein et al. | D6/192 |
| D. 267,607 | 1/1983 | Peabody et al. | D6/136 X |
| 2,657,894 | 11/1953 | Sklenar | 248/221.4 X |
| 2,843,970 | 12/1953 | Keuls | 248/220.3 X |
| 3,154,281 | 10/1964 | Irank | 248/221.4 X |
| 3,306,564 | 2/1967 | Nickel | 248/220.3 |

FOREIGN PATENT DOCUMENTS

| | | | |
|---|---|---|---|
| 509971 | 6/1955 | Italy | 211/126 |
| 782855 | 9/1957 | United Kingdom | 211/188 |

OTHER PUBLICATIONS

IBM Technical Disclosure Bulletin, vol. 19, No. 2, Jul. 1976, "Molded Fastener".

*Primary Examiner*—Robert W. Gibson, Jr.
*Attorney, Agent, or Firm*—Fidelman, Wolffe & Waldron

[57] ABSTRACT

A storage device comprising one or more grid-like basic components and at least one additional component releasably fixed thereto, the basic component being a grating having openings arranged in a single row or in a plurality of rows, the openings being defined by webs extending substantially perpendicular to the plane of the grating, the grating being provided with a frame or partial frame the rear side of which has spacing formations extending rearwardly beyond the plane of the grating, each said additional component having one or more anchoring elements which snugly engage in one or more of the said openings of the grating whereby to retain the said additional component in a mounted position on the grating.

7 Claims, 12 Drawing Figures

STORAGE DEVICE

The invention relates to a storage device comprising one or more grid-like basic components and at least one additional component releasably fixed thereto.

Known storage devices are customarily constructed like bookshelves in which individual storage shelves or storage baskets are fixed to vertical side supports at desired vertical spacings from each other. Such storage devices, which can only be placed on the floor, are generally obstructive and require considerable space.

It is an object of the invention to provide a storage device which can be used more adaptably and space savingly than known shelf systems and which can not only be used as a shelf arrangement with horizontally disposed support surfaces or baskets, but can be provided with releasably fixed storage elements such as hooks, baskets, vessels or other open or closed containers, and which can be mounted on a vertical wall.

The invention consists in a storage device comprising one or more grid-like basic components and at least one additional component releasably fixed thereto, the basic component being a grating having openings arranged in a single row or in a plurality of rows, the openings being defined by webs extending substantially perpendicular to the plane of the grating, the grating being provided with a frame or partial frame the rear side of which has spacing formations extending rearwardly beyond the plane of the grating, each said additional component having one or more anchoring elements which snugly engage in one or more of the said openings of the grating whereby to retain the said additional component in a mounted position on the grating.

The support device of the invention offers many different possibilities of use and can be mounted very space savingly. Thus, the basic component, that is to say the grating, can be mounted on a vertical wall surface and the additional components such as hooks, baskets, vessels or other containers releasably fixed thereto. Since the said additional components can be of such different natures, it is possible for widely different kinds of goods to be stored to be accommodated in a manner which allows the goods to be readily inspected and so that the goods are always readily to hand.

A plurality of the said basic components may be arranged horizontally and spaced apart vertically in the form of a set of shelves. Such a shelf arrangement can for example be placed in a tall cupboard. In such a way, the cupboard space can be better utilised and the empty cupboard space, which is frequently unused, sensibly subdivided.

In order to make the invention clearly understood, reference will be made to the accompanying drawings which are given by way of example and in which.

Figure 1:
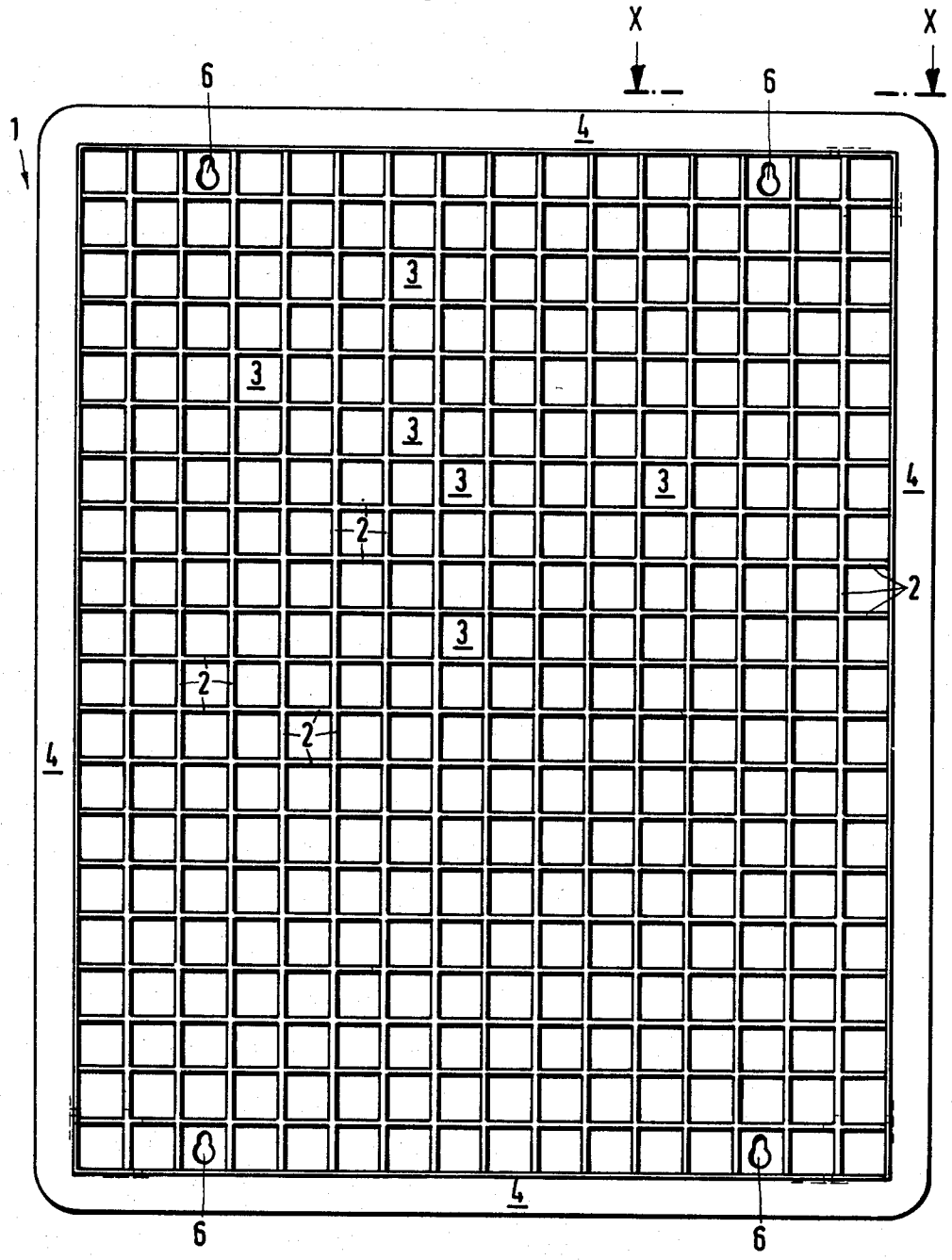
FIG. 1 is a face view of a grating which forms the grid-like basic component of the storage device of the invention.
Figure 9:
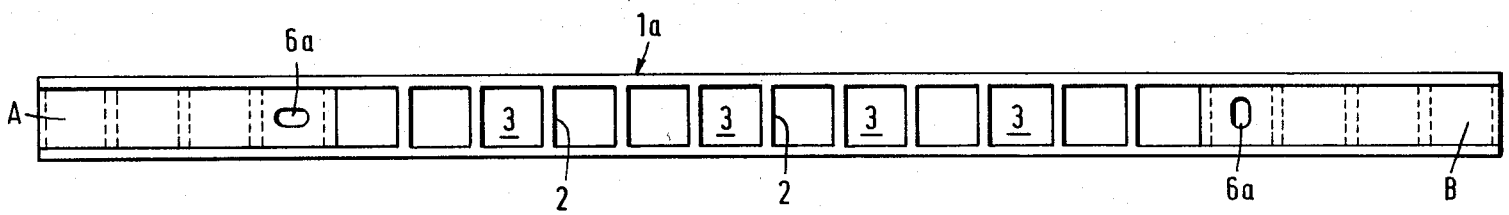
FIG. 9 is a face view of an alternative form of grating constituting the basic component of a storage device of the invention.

The basic component of the storage device of the invention is a grating 1 (FIG. 1) having openings 3 arranged in a plurality of rows or a grating 1*a* (FIG. 9) having openings 3 arranged in a single row. The openings 3 are defined by webs 2 which extend substantially perpendicular to the plane of the grating. The webs 2 are all of substantially the same thickness and the openings 3 are all of substantially the same depth.

Figure 10:
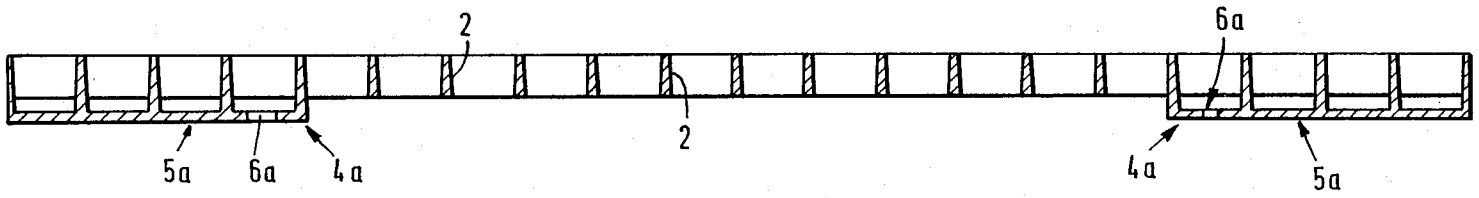
FIG. 10 is a sectional view along the line A—B of FIG. 9.
Figure 11:
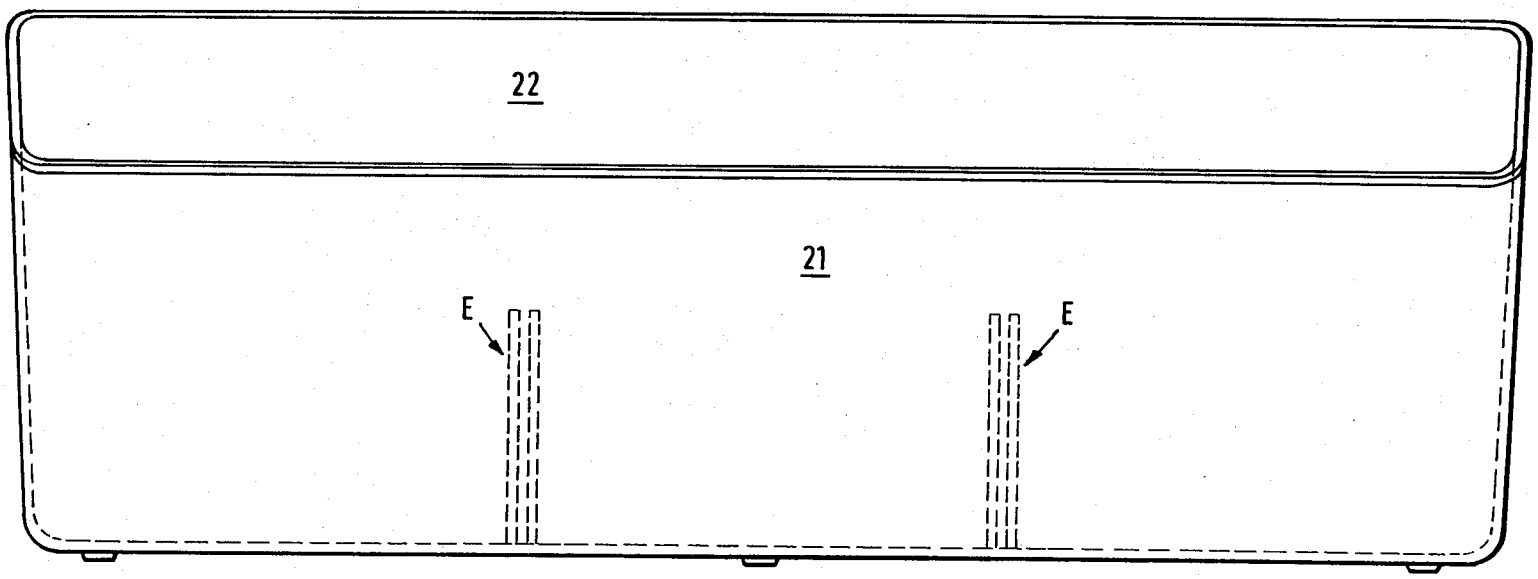
FIG. 11 is a front view of an additional component in the form of a basket unit.
Figure 12:
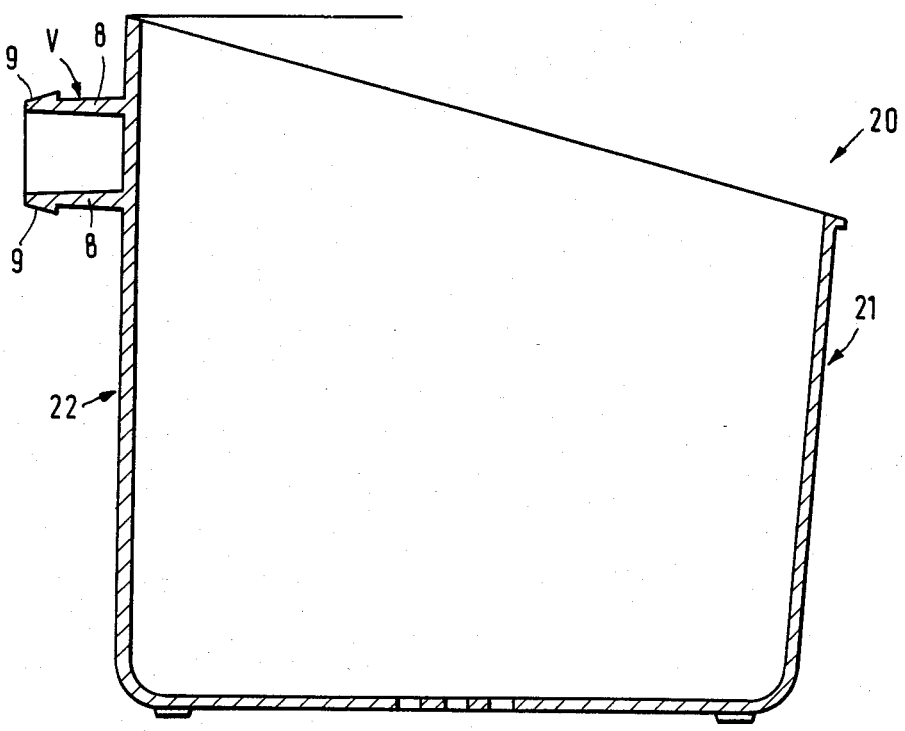
FIG. 12 is a cross sectional view of the basket unit of FIG. 11.

The grating 1 is surrounded by a frame 4 which may be integrally moulded therewith. At the rear of the frame 4, preferably bordering on the periphery of the grating 1, spacing formations 5 are formed. With the gratings 1*a* (FIGS. 9 and 10) a short part 4*a* with a spacing formation 5*a* is provided at each end of the said grating. These parts 4*a* and 5*a* serve the same purpose as the frame 4 and spacing formations 5 of the grating 1.

By means of the spacing formations, a free space is established between the rear of the grating and a wall, if the grating is mounted on a wall, the free space allowing said additional components to be secured to the grating by way of anchoring elements V which will be described subsequently. The grating 1 or 1*a* is provided with holes 6 or 6*a* which serve for receiving fixing screws (not shown). With a rectangular grating 1, these holes 6 are advantageously arranged at or near the four corners of the grating. In order to be able to easily remove the grating 1 or 1*a* from the wall, the holes are preferably slotted with the narrow slot part upwards. Screw heads (not shown) are passed through the wide parts of the slots and the grating then pushed downwards so that the portions of the screw shanks adjoining the screw heads slide into the narrow slot parts and secure the grating in position.

Additional components for the grating 1 or 1*a* are in the form of shelves, hooks, baskets, vessels or other open or closed containers. In the drawings, a shelf 7, a hook unit 11 and a basket 20 are illustrated. Other additional components may be provided with anchoring elements V in the same way as shelves and hook units, and a detailed description of such other components thus need not be given. The number of anchoring elements used for individual additional components to be mounted, depends on the length of the respective additional component.

Figure 4:
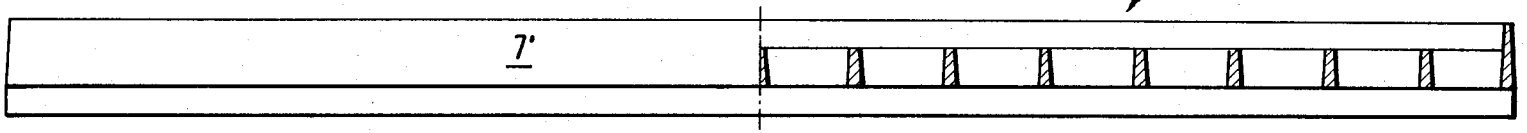
FIG. 4 is a rear view of the shelf of FIG. 3, partially in section.
Figure 3:
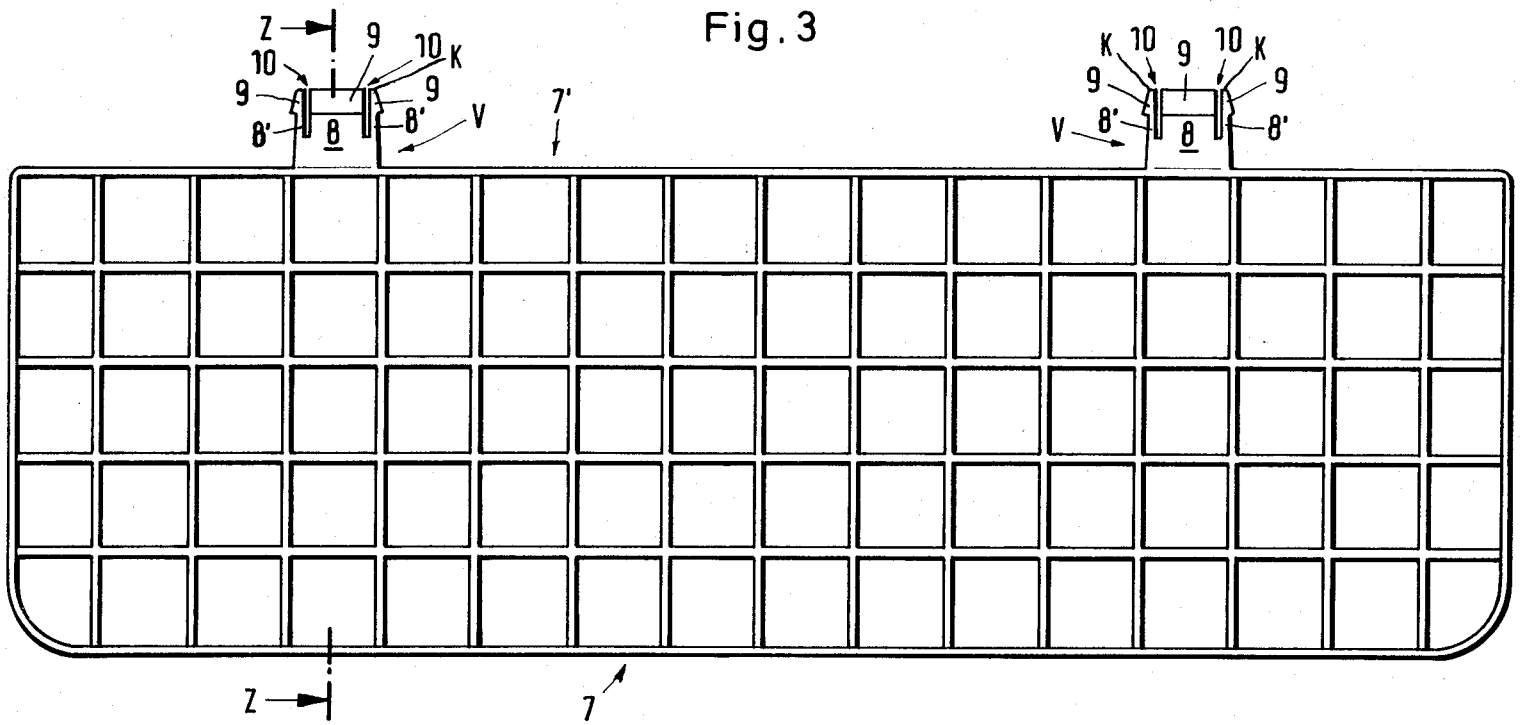
FIG. 3 is a plan view of an additional component of the storage device of the invention, in the form of a shelf with anchoring elements formed thereon.
Figure 8:
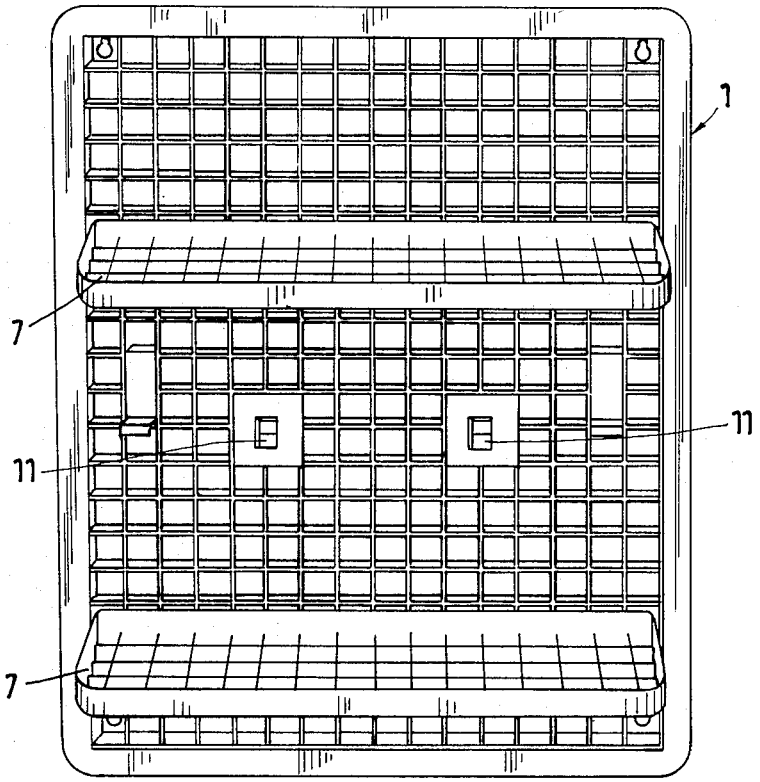
FIG. 8 is a view showing a basic grating component fitted with two shelves and two hook units.

The shelf 7 (FIG. 3) in the illustrated embodiment is itself in the form of a grating, but it can have a different grid pitch or can be constructed as a plain panel shelf. The rear side 7' of the shelf 7 (FIG. 4) is in the form of a strip disposed perpendicular to the plane of the shelf, on which the anchoring elements V are formed. The said strip at the rear side 7' is preferably at least as high as the height of a grating opening 3 in the grating 1 or 1a. Thus the said strip completely covers the base regions of the anchoring elements V and gives them a high stability.

An anchoring element V consists of two plates 8, 8 arranged parallel to each other, or four such plates 8, 8, 8', 8' arranged at right angles. The cross section of the rectangle formed by the plates 8, 8 and 8', 8' corresponds to the size of a grating opening 3 in the grating 1 or 1a, so that the anchoring element V can be inserted with a snug fit in such a grating opening 3.

At least two oppositely disposed plates, preferably the two plates which extend parallel to the upper and lower sides of the shelf 7, are resiliently elastic and are longer than the depth of the grating 1 or 1a which is determined by the depth of the webs 2. At the free end regions of each of these plates 8, 8, outwardly projecting detent protrusions 9 are provided which taper in the direction towards the end K of the said free end region. It is thereby achieved that on insertion of an anchoring element into a grating opening 3, the free ends of the plates 8, 8 or 8', 8' are pushed together somewhat, as the anchoring element slides into the opening 3, by the co-action of tapering detent protrusions 9 and the webs 2 bordering the opening 3, until the detent protrusions 9 have moved as far as the rear side of the grating. At that moment the detent protrusions 9 are released by the webs 2 and the plates 8, 8 spring back into their original positions and engage the rear edges of the webs 2 and hold the shelf 7 on the grating 1 or 1a.

The plates 8, 8 and 8', 8' may be of equal length. In this case two of the oppositely disposed plates 8, 8 or 8', 8' are provided with slits 10 (FIG. 3) extending from the free ends K, which separate the said two plates from the immediately adjoining two plates. The slits 10 are sufficiently deep as to ensure that the plates having the detent protrusions 9 can be resiliently pressed towards each other.

Figure 5:
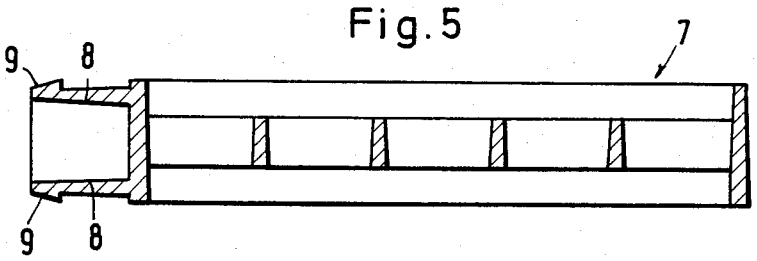
FIG. 5 is a sectional view along the line Z—Z of FIG. 3.

All four plates 8, 8 and 8', 8' may be provided with detent protrusions. Alternatively, however, only two plates 8, 8 may be provided, which have detent protrusions 9 (FIG. 5). Advantageously the plates provided with detent protrusions are those which are arranged parallel to the upper and lower sides of the shelf, vessel, basket or other container. The length of the component to be mounted determines the number of anchoring elements, in order to provide a stable mounting thereof on the grating 1. The anchoring element V is designed for insertion into a single grating opening 3.

Figure 6:
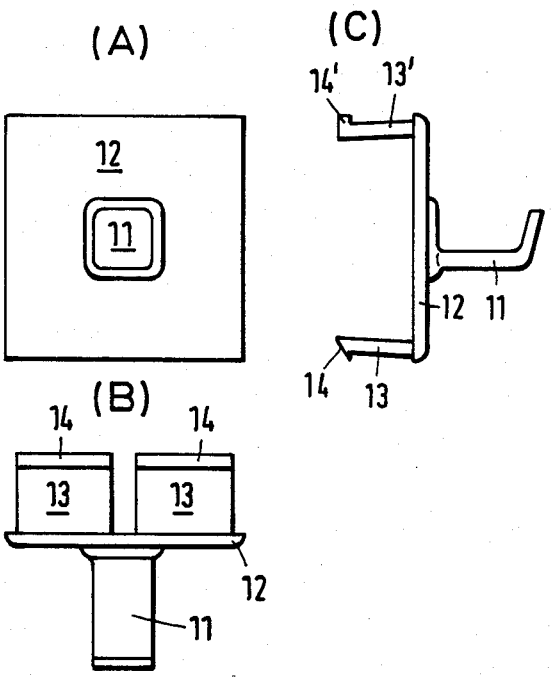
FIG. 6 is a group of three views of an additional component in the form of a hook unit, view A being a face view, view B being a downward view and view C being a side view.

FIG. 6 shows a hook unit having a hook 11 formed on a support plate 12 the area of which covers four adjacently disposed openings 3 in the grating 1. On the side of the support plate 12 remote from the hook 11, two pairs of respectively aligned plates 13, 13 and 13', 13' are provided, which form anchoring elements. The plates are so dimensioned and positioned that each plate can engage in a respective one of four adjacent openings 3 of the grating 1, said four openings being in two rows. The plates 13' have detent protrusions 14' of rectangular section, that is to say, which do not taper, whereas the plates 13 have detent protrusions 14 which taper towards the free end of the plates 13. When inserting this kind of anchoring element V' in the grating openings 3, the detent protrusions 14' of the upper lying plates 13' are first engaged with the webs 2 at the rear of the grating, with the support plate 12 somewhat inclined and then the support plate 12 pressed down so that the two tapering detent protrusions 14 move through the respective grating openings 3 until they latch at the near side of the respective webs 2.

As a result of the provision of the spacing formations 5 or 5a described above, there is enough free space between a wall and the grating 1 mounted thereon, for the detent protrusions 9 or 14 and 14'.

FIGS., 11 and 12 show an additional component in the form of a basket 20. The anchoring elements V are at the rear side of the basket 20 and are constructed as described above. The front side of the basket 20 is advantageously kept lower than the rear side 22 so that the interior of the basket 20 is easily accessible. Various inserts E may be provided in the interior of the basket 20, for example dividing walls or holding bars. All of the additional components can be mounted in either the grating 1 or the grating 1a and anchored therein.

In order to release a mounted component from the grating 1 or 1a, the resiliently elastic plates 8, 8 or 8', 8' or 13, 13' and the detent protrusions 9 or 14, 14' are gently pressed towards each other so that the anchoring element V or V' is released from the detent engagement and can be drawn out from the corresponding grating opening 3.

Figure 2:
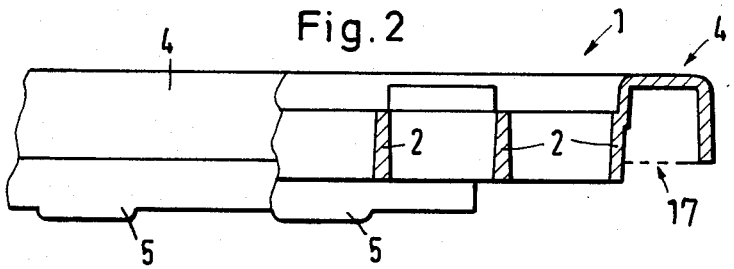
FIG. 2 is a view, to a larger scale than FIG. 1, of a portion of the component of FIG. 1, the view being an elevation of the portion of FIG. 1 indicated by the line X—X therein, but partially in section.
Figure 7:
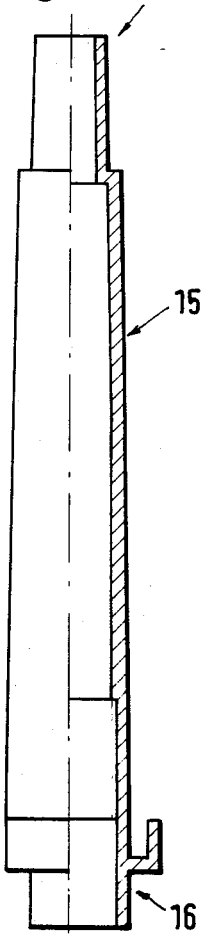
FIG. 7 is a view of a vertical support member, partially in section.

By means of support members 15 (FIG. 7) a plurality of gratings 1 can be mounted horizontally, spaced vertically from each other. Such a support member 15 is so constructed at one end 16 that it fits into a channel 17 (FIG. 2) which is formed at the rear side of the grating 1 by the spacing formation 5. The other end 16' of the support member 15 is shaped to fit an opening 3 in the grating 1, so that it can be snugly received in this grating opening. However, the support member 15 may alternatively be so constructed that it can be snugly fitted at both ends into grating openings of respective gratings arranged one above the other.

Synthetic plastics are suitable materials for the storage device of the invention. It can also be manufactured from metal.

I claim:

1. A storage device supportable on vertical and horizontal surfaces and comprising a grid-like basic component in the form of a grating having a frame, at least one row of openings, and spacer means for spacing a rear plane of said basic component from a support surface; at least one additional component attached to said basic component by means for releasably anchoring said basic and additional components together; said grating openings all being of substantially like depth as defined by web portions of substantially like thicknesses and extending substantially perpendicularly from said rear plane; said anchoring means comprising at least one rearwardly extending portion of said additional component, said portion being resiliently elastic and having a configuration anchorably mateable with an opening of said grating, and wherein the additional component is a hook unit comprising a plate on the front of which two pairs of retaining members are provided, the retaining members forming anchoring elements for the hook unit, the retaining members being resiliently elastic plates having detent formations engageable with the rear of the grating, the plates being so dimensioned and spaced that each plate engages in a respective one of four adjacent openings of the grating.

2. A storage device supportable on vertical and horizontal surfaces and comprising a grid-like basic component in the form of a grating having a frame, at least one row of openings, and spacer means for spacing a rear plane of said basic component from a support surface; means for stacking said basic component and at least one other of said basic component such that said planes are generally horizontal and spaced apart vertically, said stacking means fitting snugly within said grating openings of at least one said basic component; at least one additional component attached to said basic component by means for releasably anchoring said basic and additional components together; said grating openings all being of substantially like depth as defined by web portions of substantially like thicknesses and extending substantially perpendicularly from said rear plane; said anchoring means comprising at least one rearwardly extending portion of said additional component, said portion being resiliently elastic and having a configuration anchorably mateable with an opening of said grating.

3. A storage device as in claim 2, wherein said stacking means is engageable in channels of said spacer means of at least one other of said basic components.

4. A storage device supportable on vertical and horizontal surfaces and comprising a grid-like basic component in the form of a grating having a frame, at least one row of openings, and spacer means for spacing a rear plane of said basic component from a support surface; at least one additional component attached to said basic component by means for releasably anchoring said basic and additional components together; said grating openings all being of substantially like depth as defined by web portions of substantially like thicknesses and extending substantially perpendicularly from said rear plane; said anchoring means comprising at least two pairs of rearwardly extending portions of said additional component and having a configuration anchorably mateable with an opening of said grating, said anchoring means portions being spaced apart, generally parallel plate-like portions, each of said portions being resiliently elastic and longer than said grating openings depth and having a free end with a tapered detent means for engaging a web portion and flexing said free end away from said web portion during insertion of said free end into one of said grating openings and for engaging said rear plane upon clearing said opening depth such that said free end flexes back toward said web portion, the plate-like portions of a first pair being perpendicular to the plate-like portions of a second pair.

5. A storage device supportable on vertical and horizontal surfaces and comprising a grid-like basic component in the form of a grating having a frame, at least one row of openings, and spacer means for spacing a rear plane of said basic component from a support surface; at least one additional component attached to said basic component by means for releasably anchoring said basic and additional components together; said grating openings all being of substantially like depth as defined by web portions of substantially like thicknesses and extending substantially perpendicularly from said rear plane; said anchoring means comprising at least one rearwardly extending portion of said additional component, said portion being resiliently elastic and having a configuration anchorably mateable with an opening of said grating, said anchoring means portions being spaced apart, generally parallel plate-like portions, each of said portions being resiliently elastic and longer than said grating openings depth and having a free end with a tapered detent means for engaging a web portion and flexing said free end away from said web portion during insertion of said free end into one of said grating openings and for engaging said rear plane upon clearing said opening depth such that said free end flexes back toward said web portion, each plate-like portion of said two pairs being generally parallel to each other.

6. A storage device supportable on vertical and horizontal surfaces and comprising a grid-like basic component in the form of a grating having a frame, at least one row of openings, and spacer means for spacing a rear plane of said basic component from a support surface; at least one additional component attached to said basic component by means for releasably anchoring said basic and additional components together; said grating openings all being of substantially like depth as defined by web portions of substantially like thicknesses and extending substantially perpendicularly from said rear plane; said anchoring means comprising at least one rearwardly extending portion of said additional component, said portion being resiliently elastic and having a configuration anchorably mateable with an opening of said grating, said anchoring means portions being spaced apart, generally parallel plate-like portions, each of said portions being resiliently elastic and longer than said grating openings depth and having a free end with a tapered detent means for engaging a web portion and flexing said free end away from said web portion during insertion of said free end into one of said grating openings and for engaging said rear plane upon clearing said opening depth such that said free end flexes back toward said web portion, and wherein each anchoring means has four said plate-like portions all of substantially the same length, the adjacent portions being separated from each other by slits extending from the free end of the anchoring means.

7. A storage device supportable on vertical and horizontal surfaces and comprising a grid-like basic component in the form of a grating having a frame, at least one row of openings, and spacer means for spacing a rear plane of said basic component from a support surface; at least one additional component attached to said basic component by means for releasably anchoring said basic and additional components together; said grating openings all being of substantially like depth as defined by web portions of substantially like thicknesses and extending substantially perpendicularly from said rear plane; said anchoring means comprising at least one rearwardly extending portion of said additional component, said portion being resiliently elastic and having a configuration anchorably mateable with an opening of said grating, said anchoring means portions having spaced apart, generally parallel plate-like portions, each of said portions being resiliently elastic and longer than said grating openings depth and having a free end with a tapered detent means for engaging a web portion and flexing said free end away from said web portion during insertion of said free end into one of said grating openings and for engaging said rear plane upon clearing said opening depth such that said free end flexes back toward said web portion, each of said shelves comprising a grating.

* * * * *